United States Patent [19]

Nakano et al.

[11] Patent Number: 4,517,930

[45] Date of Patent: May 21, 1985

[54] PISTON OF COMBUSTION ENGINE

[75] Inventors: Hideaki Nakano, Akashi; Tadahiro Ozu, Kobe; Eiichi Shirai, Amagasaki, all of Japan

[73] Assignee: Kawasaki Jukogyo Kabushiki Kaisha, Kobe, Japan

[21] Appl. No.: 425,340

[22] Filed: Sep. 28, 1982

[51] Int. Cl.[3] ..... F01P 3/10

[52] U.S. Cl. ..... 123/41.31; 123/41.35; 123/193 P; 92/186; 92/231; 92/224; 92/260

[58] Field of Search ..... 123/41.34, 41.35, 41.31, 123/41.16, 193 R, 193 EP, 193 P; 92/186, 260, 231, 224

[56] References Cited

U.S. PATENT DOCUMENTS 4,083,292 4/1978 Goloff ..... 92/186

FOREIGN PATENT DOCUMENTS 629977 4/1936 Fed. Rep. of Germany .
2016386 12/1971 Fed. Rep. of Germany .
2546388 4/1977 Fed. Rep. of Germany .
496707 12/1938 United Kingdom .
649351 1/1951 United Kingdom .
840145 7/1960 United Kingdom .
1246586 9/1971 United Kingdom .
1261661 1/1972 United Kingdom .
1501387 2/1978 United Kingdom .
2075147 11/1981 United Kingdom ..... 123/41.35

*Primary Examiner*—Craig R. Feinberg
*Assistant Examiner*—David A. Okonsky
*Attorney, Agent, or Firm*—Marshall, O'Toole, Gerstein, Murray & Bicknell

[57] ABSTRACT

A piston is provided for an internal combustion engine, having a crown portion comprising an upper part and a lower or ring-bearing part which two parts are of different metals welded together. The two metals are chosen to have the same coefficient of expansion but the metal of the upper part of the piston crown is less heat-conductive while that of the ring-bearing part is highly heat-conductive. The piston has a cooling chamber formed in it, part of which chamber is adjacent the upper part of the piston crown while another part of the cooling chamber is adjacent the ring-bearing part.

5 Claims, 3 Drawing Figures

PISTON OF COMBUSTION ENGINE

DETAILED DESCRIPTION

This invention relates to a piston construction for internal combustion engines, particularly diesel engines.

In general, internal combustion engine pistons are made of solid aluminium or solid cast iron, but recently the use of so-called composite pistons which have a steel crown exposed to the heat of combustion within the combustion chamber is increasing. The crown is formed integrally with a ring carrier portion which receives piston rings to slide within the cylinder liner gas-tightly with oil lubrication. The composite pistons have a cooling chamber therein to cool both the ring carrier portion of the crown and the upper portion adjacent the combustion chamber.

The ring carrier should be well heat-conductive to be sufficiently cooled so that the oil lubrication is effective, while the upper portion of the crown should be less heat-conductive to resist the transmission of the heat of combustion from the combustion chamber to the piston rings. The upper crown portion may also be less heat-conductive to insulate the heat so that its energy is used effectively to increase the heat efficiency. Thus, one integral piston requires opposed thermal characteristics.

It is an object of this invention to provide a piston construction with its piston rings adapted to be cooled sufficiently to eliminate seizure, extraordinary wear, adhesion and the like between the rings and the cylinder liner which tends to occur at high temperatures and which may cause scuffing.

A piston according to this invention comprises a crown and a skirt fixed together, said crown including an upper part of less heat-conductive metal and a ring carrier of highly heat-conductive metal, said upper part and ring carrier being welded together, said piston having a cooling chamber formed therein to pass a coolant through said chamber.

A preferred embodiment of this invention will now be described by way of example with reference to the accompanying drawaings, wherein.

Figure 1:
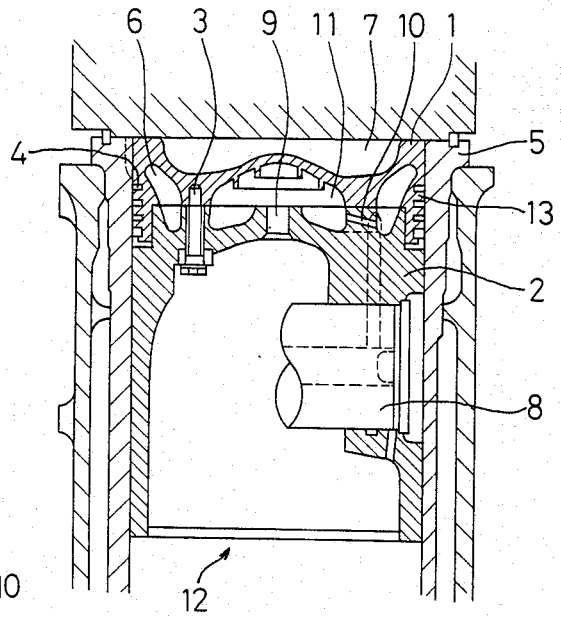
FIG. 1 PRIOR ART
FIG. 1 is a partial view in axial section of a conventional piston.

Referring to FIG. 1, the conventional piston comprises a crown 1 secured to a skirt 2 by bolts 3. The crown 1 is formed integrally with a ring carrier 13 which receives piston rings 4. The piston has a cooling chamber 6 formed therein communicating with an oil path in the piston pin 8. Aa coolant oil is supplied through the oil path to the chamber 6 for heat exchange by "oil shaker" to cool the ring carrier 13 etc. The oil then flows through a path 10, a central chamber 11 and an opening 9 and falls into the crank chamber 12.

The crown 1 is generally made of cast or forged steel which is well heat-conductive so that the rings 4 are sufficiently cooled, and the skirt 2 is generally made of aluminium alloy or cast iron. The well heat-conductive crown 1, however, transmits a great amount of heat of combustion from the combustion chamber 7 to the rings 4, thus preventing the rings from being cooled.

Figure 3:
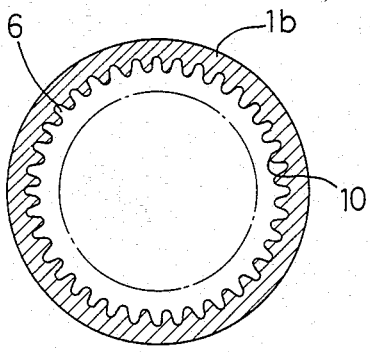
FIG. 3 is a cross-sectional view of the crown of the piston of FIG. 2.
Figure 2:
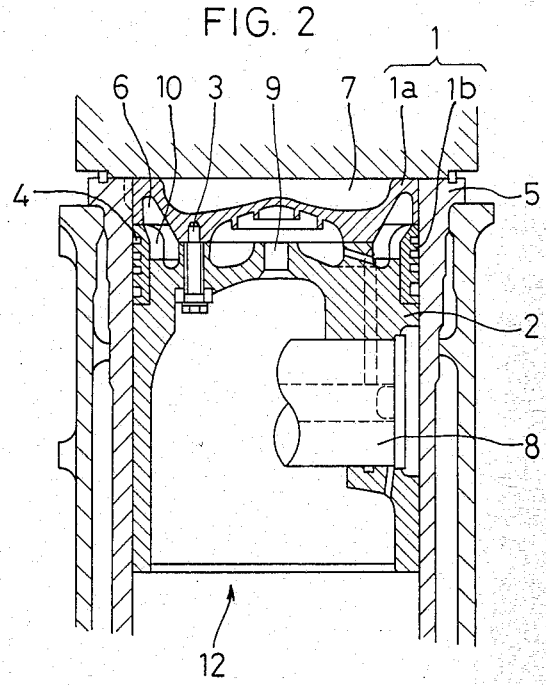
FIG. 2 is a partial view in axial section of a piston according to this invention.

Referring now to FIGS. 2 and 3 showing the present invention, the piston comprises a crown 1 facing the combustion chamber 7 and a skirt 2 to which the crown 1 is secured by bolts 3.

The crown 1 includes an upper part 1*a* and a lower part or ring carrier 1*b* which receives piston rings 4 for the lubrication and gas sealing between the piston and the cylinder liner 5. Each of the parts 1*a* and 1*b* is made of material different from the other but having a similar coefficient of thermal expansion. The parts 1*a* and 1*b* are welded together preferably by electron-beam welding, or by arc welding. The upper part 1*a* of the crown is made of less heat-conductive and highly heat-resistive material. The ring carrier 1*b* is made of highly heat-conductive material. The parts 1*a* and 1*b* may be of alloy steel.

The piston has an annular cooling chamber 6 formed therein extending in the crown 1 and skirt 2 and surrounded by a peripheral wall of the upper part 1*a* and an upper portion of the ring carrier 1*b* to cool the parts 1*a* and 1*b*.

As shown in FIG. 3, the ring carrier 1*b* has fins 10 formed in its inside projecting into the cooling chamber 6 to facilitate the cooling of the ring carrier 1*b*, especially for high output engines. The forming of such fins can be easily performed by separating the parts 1*a* and 1*b*.

The other parts of the piston may have substantially the same construction as the conventional piston of FIG. 1.

By thus forming the piston according to this invention, only a small amount of heat of combustion is transmitted to the ring carrier through the upper part of the crown which is less heat-conductive to act as a heat insulator. Also, the ring carrier is highly heat-conductive so as to sufficiently cool the piston rings, keeping good oil lubrication at the rings to reduce scuffing.

What we claim is:

1. A piston for an internal combustion engine, said piston being adapted to reciprocate in an engine cylinder and to support one or more piston rings which slidingly engage the wall of the cylinder, said piston comprising a crown and a skirt fixed together, said crown including an upper part of relatively low heat-conductive metal and a ring carrier of relatively high heat-conductive metal, said upper part and said ring carrier being welded together, said piston having a cooling chamber formed therein to pass a coolant through said chamber, said upper part including a relatively thin cylindrical peripheral wall portion which extends from substantially the upper surface of said crown to said ring carrier, whereby said ring carrier is separated from said upper surface by said peripheral wall portion, and the outer surfaces of said peripheral wall portion and said ring carrier are substantially aligned and are closely adjacent said wall of said cylinder.

2. A piston as claimed in claim 1, wherein said ring carrier has fins formed therein which project into said cooling chamber.

3. A piston as claimed in claim 1, wherein portions of said cylindrical wall portion and said ring carrier form sides of said cooling chamber.

4. A piston as claimed in claim 1, wherein said upper part and said ring carrier have substantially the same coefficients of thermal expansion.

5. A piston as claimed in claim 1, wherein said cooling chamber comprises an annular outer chamber which is adjacent said peripheral wall and said ring carrier, an inner chamber between said upper part and said skirt, a first passage connected to said outer chamber, a second passage between said outer and inner chambers, and a third passage connected to said inner chamber.

* * * * *